US008998199B2

(12) United States Patent
Kojima

(10) Patent No.: US 8,998,199 B2
(45) Date of Patent: Apr. 7, 2015

(54) SHEET STACKING APPARATUS AND IMAGE FORMING APPARATUS

(71) Applicant: Canon Kabushiki Kaisha, Tokyo (JP)

(72) Inventor: Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/249,439

(22) Filed: Apr. 10, 2014

(65) Prior Publication Data

US 2014/0312560 A1 Oct. 23, 2014

(30) Foreign Application Priority Data

Apr. 23, 2013 (JP) ..... 2013-090538

(51) Int. Cl.
*B65H 31/26* (2006.01)

(52) U.S. Cl.
CPC ..... *B65H 31/26* (2013.01)

(58) Field of Classification Search
CPC ..... B65H 31/26; B65H 2405/1124; B65H 2405/115
USPC ..... 271/207, 220; 399/405; 347/104; 101/240
See application file for complete search history.

(56) References Cited

U.S. PATENT DOCUMENTS

| | | | | |
|---|---|---|---|---|
| 2,991,999 | A * | 7/1961 | Doerner | 271/220 |
| 7,597,315 | B2 * | 10/2009 | Yamamoto et al. | 271/145 |
| 7,784,781 | B2 * | 8/2010 | Asada | 271/145 |
| 8,047,534 | B2 * | 11/2011 | Sugiyama et al. | 271/167 |
| 8,382,090 | B2 * | 2/2013 | Sasamoto et al. | 270/58.07 |
| 8,746,684 | B2 * | 6/2014 | Okano et al. | 271/171 |

FOREIGN PATENT DOCUMENTS

JP 07-315670 A 12/1995

* cited by examiner

*Primary Examiner* — David H Bollinger
(74) *Attorney, Agent, or Firm* — Fitzpatrick, Cella, Harper & Scinto

(57) ABSTRACT

A sheet stacking apparatus comprising: a sheet stacking portion on which a sheet discharged from a sheet discharge port is stacked; a cover portion configured to move to a closed position for covering the sheet discharge port and the sheet stacking portion and an open position for allowing taking out of the sheet stacked on the sheet stacking portion; a sheet pressing portion configured to move to a press-down position for pressing the sheet stacked on the sheet stacking portion and an apart position that is distant from the sheet stacked on the sheet stacking portion; and a movement-linking portion configured to cause the sheet pressing portion to move from the apart position to the press-down position upon an opening movement of the cover portion.

13 Claims, 7 Drawing Sheets

SHEET STACKING APPARATUS AND IMAGE FORMING APPARATUS

BACKGROUND OF THE INVENTION

1. Field of the Invention

The present invention relates to a sheet stacking apparatus for stacking a sheet discharged from a sheet discharge port, and also relates to an image forming apparatus provided with the sheet stacking apparatus.

2. Description of the Related Art

Conventionally, an image forming apparatus thermally fixes a toner image formed on a sheet, discharges the sheet from a sheet discharge port, and stacks the sheet on a sheet stacking tray located outside the apparatus.

In recent years, the air conditioning at a work place or offices does not often rely on air conditioners alone, in view of energy saving and environmental issues. For example, windows are opened at offices and electric fans are used for the air circulation. Even in the winter season, electric fans are used together with a heating system. The electric fans cause the air to circulate in the offices in order to increase a heating efficiency.

In such environment, an image forming apparatus may be situated near the windows, and the electric fan may be put near the image forming apparatus. In this case, the wind from the open windows or the electric fan may disturb an arrangement of sheets on a sheet stacking tray, blow off the sheets, and cause the sheets to drop from the tray. If the wind blows against the sheets that are being discharged, the sheets are disturbed by the changing intensity of the wind, and the order of the sheets stacked may be different from the order of the sheets discharged. Then, the sheets are not stacked in the desired order of pages. In this manner, the wind blowing against the sheet stacking tray may deteriorate the sheet stacking performance. In particular, thin sheets are easy to fly with the wind, and the sheet stacking performance may significantly deteriorate.

In some countries, the image forming apparatus is installed outside the office building. In a certain country, for example, a street stall may have an image forming apparatus located inside the street stall. This is a copy-taking shop on the street. In such on-the-street copy-taking shop, the sheet(s) on the sheet stacking tray may fly with the wind, drop on the street, scatter, and become dirty.

In order to prevent the sheet(s) from falling off from the sheet stacking tray and scattering, Japanese Patent Laid-Open No. 7-315670, for example, proposed one technique.

According to the technique disclosed in Japanese Patent Laid-Open No. 7-315670, the sheet stacking tray is formed on the upper face of the apparatus main unit cover. A sheet pressing member is pivotably provided on the cover for pressing the stacked sheet(s) toward the sheet stacking tray so that the sheets stacked on the sheet stacking tray do not fall from the sheet stacking tray or scatter even when the apparatus main unit cover is opened.

With the technique disclosed in Japanese Patent Laid-Open No. 7-315670, it is possible to press those sheets which are already stacked on the sheet stacking tray by the sheet pressing member, but it is not possible to press those sheets which are being discharged. As such, when the wind blows against the sheets that are discharged toward the sheet stacking tray during the discharging process, the order of the sheets discharged may be different from the order of the sheets stacked on the tray, and the sheets are not stacked in the order of pages.

SUMMARY OF THE INVENTION

In view of the above problems, the present invention provides a sheet stacking apparatus that can prevent the disordered stacking of the sheets even when the wind blows against the sheets during the sheet discharging process and can prevent the sheets from flying from the sheet stacking tray even when the wind blows against the sheets stacked on the sheet stacking tray.

A sheet stacking apparatus of the present invention includes a sheet stacking portion on which a sheet discharged from a sheet discharge port is stacked; a cover portion configured to move to a closed position for covering the sheet discharge port and the sheet stacking portion and an open position for allowing a user to take out the sheet stacked on the sheet stacking portion; a sheet pressing portion configured to move to a press-down position for pressing the sheet stacked on the sheet stacking portion and an apart position that is distant from the sheet stacked on the sheet stacking portion; and a movement-linking portion configured to cause the sheet pressing portion to move from the apart position to the press-down position upon an opening movement of the cover portion.

Further features of the present invention will become apparent from the following description of exemplary embodiments with reference to the attached drawings.

DESCRIPTION OF THE EMBODIMENTS

Figure 1:
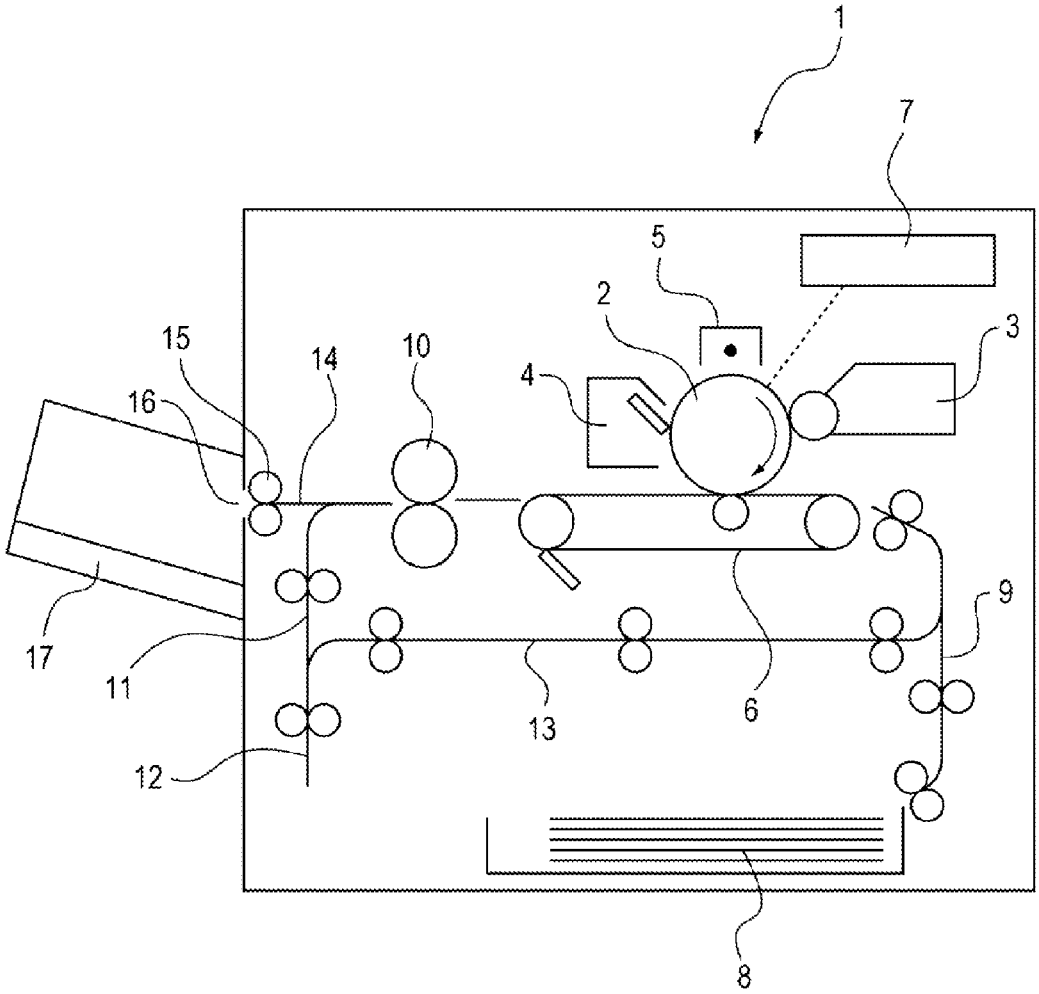
FIG. 1 is a schematic cross-sectional view that is useful to explain a general structure of an image forming apparatus that includes a sheet stacking portion.

Now, preferred embodiments of the present invention will be described in detail with reference to the drawings. It should be noted that dimensions, materials and shapes of elements and components described in the following embodiments and the relative positions between these elements and components may appropriately be changed and/or modified depending upon a configuration of an apparatus to which the present invention is applied and/or various conditions. Thus, the present invention is not limited to the dimensions, materials, shapes and the relative positions described in the following embodiments unless otherwise mentioned in an explicit manner.

<Embodiment 1>Referring to the drawings, an image forming apparatus equipped with a sheet stacking apparatus according to Embodiment 1 will be described. Firstly, the image forming apparatus will be described, and then the sheet stacking portion, which is the sheet stacking apparatus, will be described.

FIG. 1 is a schematic cross-sectional view that is useful to describe a general structure of an electrophotographic copying machine, which is the image forming apparatus. The structure of the image forming apparatus will be described with reference to FIG. 1. An apparatus main unit 1 of the image forming apparatus is configured as follows.

Reference numeral 2 designates a drum-shaped electrophotographic photoreceptor, which is an image bearing member (referred to as photosensitive drum). Reference numeral 3 designates a developing machine for attaching a developer (toner) onto a latent image formed on the photosensitive drum 2 for visualization of the image. Reference numeral 4 designates a cleaning device for removing the developer remaining on the photosensitive drum 2 and other attached matters on the photosensitive drum. Reference numeral 5 designates a primary charger for uniformly charging the surface of the photosensitive drum 2. Reference numeral 6 designates a transfer portion for transferring the developer image (toner image) on the photosensitive drum 2 onto a sheet. The above-described components are collectively referred to as an image forming portion for forming an image on a sheet.

Reference numeral 7 designates an exposing portion for exposing image information onto the surface of the photosensitive drum 2 to form a latent image. Reference numeral 8 designates a sheet feeding portion for feeding a sheet to the image forming portion. Reference numeral 9 designates a main unit path for conveying a sheet to the image forming portion from the sheet feeding portion 8. Reference numeral 10 designates a fixing device for thermally fixing a developer image, which is transferred in the image forming portion, onto a sheet. Reference numeral 11 designates a re-feeding path for guiding a sheet, which is re-fed in a two-sided recording process, reference numeral 12 designates a reversing path for reversing (inverting) a sheet, and reference numeral 13 designates a two-sided recording path for conveying the reversed sheet to the image forming portion. Reference numeral 14 designates a discharge path for discharging a sheet. Reference numeral 15 designates discharge rollers (discharging portion) for discharging a sheet from the sheet discharge port 16. Reference numeral 17 designates a sheet stacking portion (sheet stacking apparatus) for stacking a sheet discharged from the sheet discharge port 16.

Figure 2:
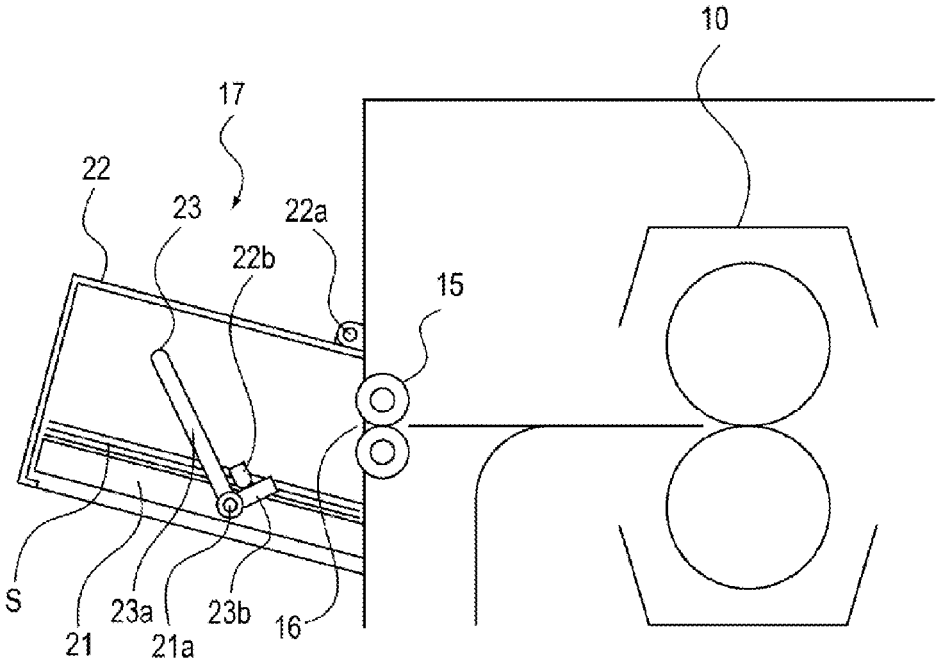
FIG. 2 is a cross-sectional view of major components of the sheet stacking portion in the image forming apparatus.
Figure 3:
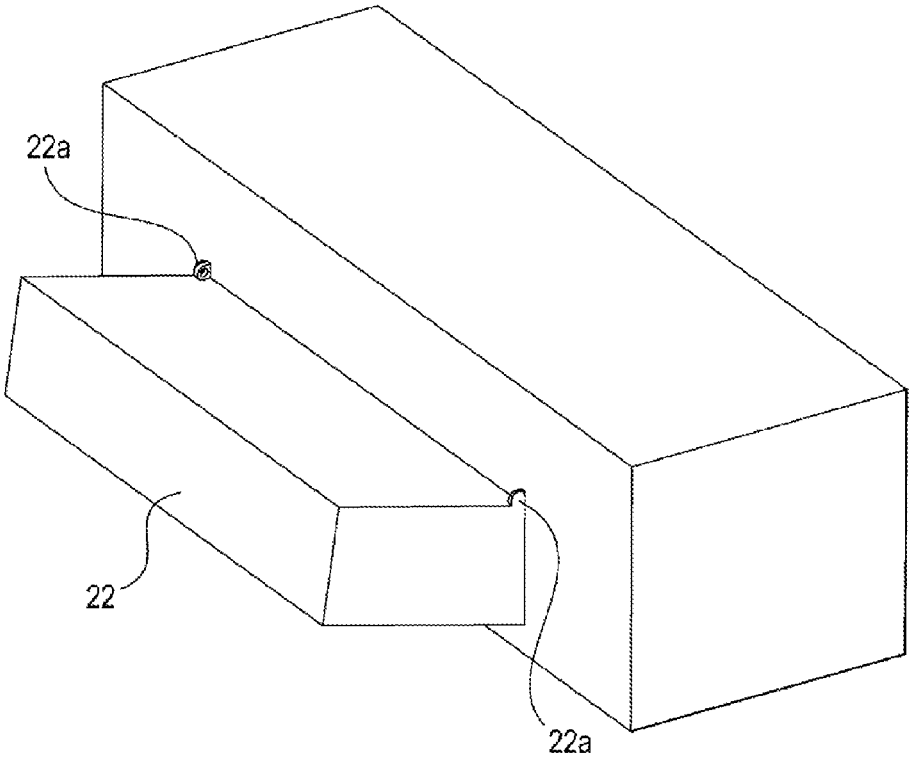
FIG. 3 is a perspective view of major components of the sheet stacking portion of the image forming apparatus.
Figure 4:
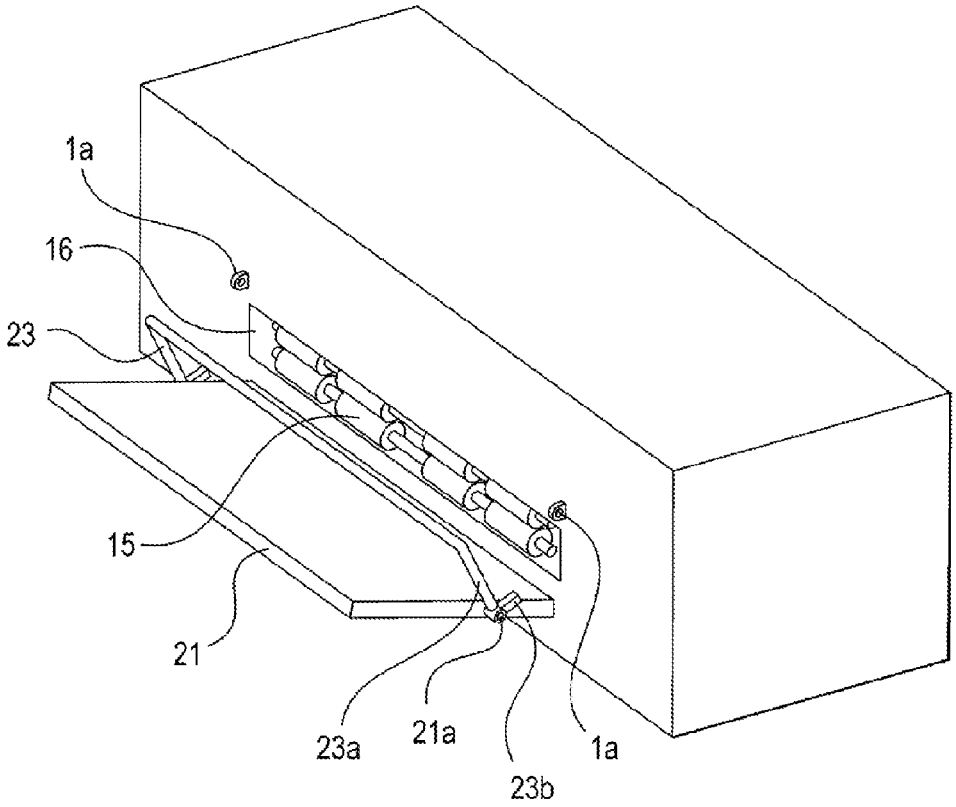
FIG. 4 illustrates a perspective view of major components of the sheet stacking portion without a cover.
Figure 5:
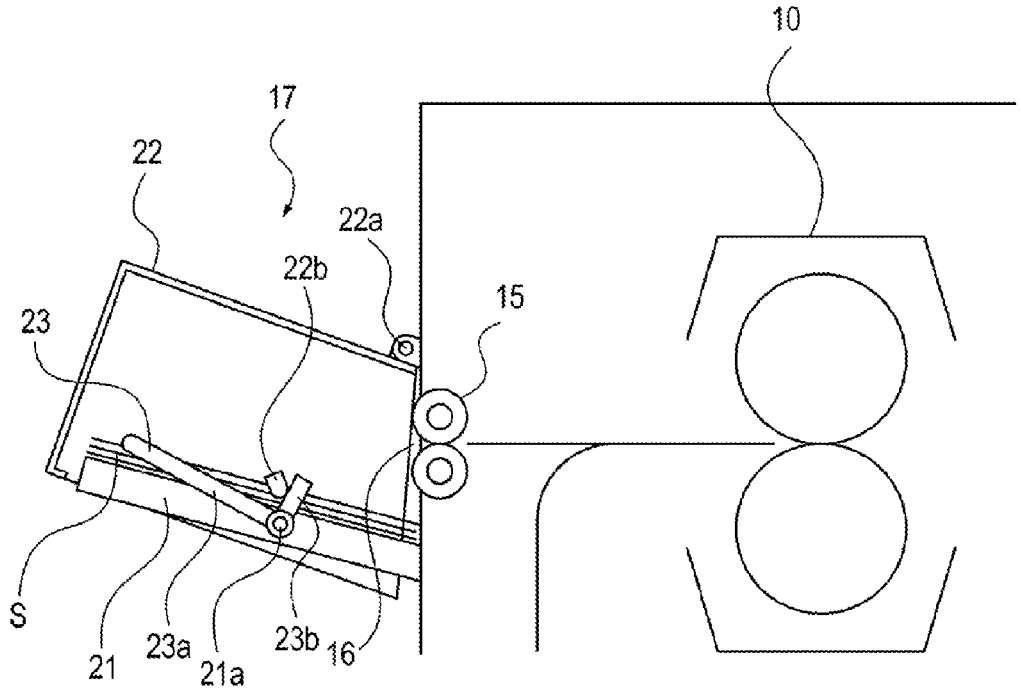
FIG. 5 illustrates a cross-sectional view of major components which is useful to explain movements in the sheet stacking portion according to Embodiment 1.
Figure 6:
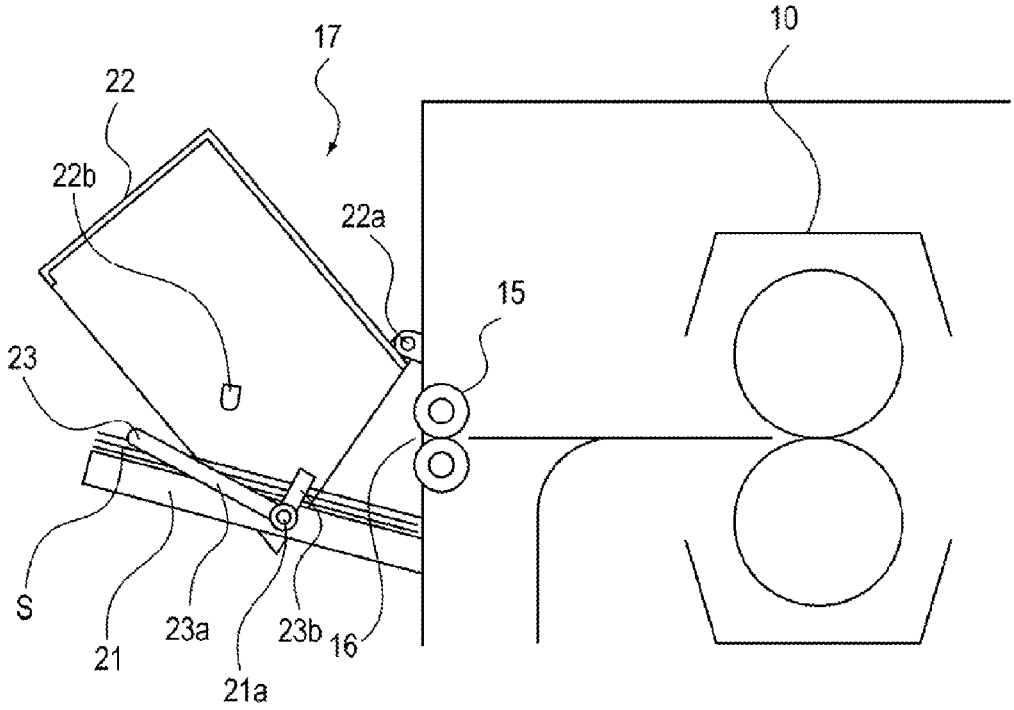
FIG. 6 illustrates a cross-sectional view of major components which is useful to explain the movements in the sheet stacking portion according to Embodiment 1.

Referring now to FIGS. 2, 3, 4 and 6, the structure of the sheet stacking portion 17 will be described in detail. FIG. 2 is a cross-sectional view of major components of the sheet stacking portion in the image forming apparatus, FIG. 3 is a perspective view of major components of the sheet stacking portion in the image forming apparatus, and FIG. 4 is a perspective view of major components of the sheet stacking portion without a cover over a sheet stacking tray. FIGS. 5 and 6 are cross-sectional views of major components respectively, which are useful to describe movements in the sheet stacking portion. Specifically, FIG. 5 illustrates a state when the cover is being opened, and FIG. 6 illustrates a state when the cover is at an open position.

The sheet stacking portion 17 includes the sheet stacking tray 21, a cover member 22 as a cover portion for covering the sheet stacking tray 21, and a sheet pressing member (sheet pressing portion) 23.

The sheet stacking tray 21 is provided outside the apparatus, and stacks (receives) a sheet discharged from the sheet discharge port 16.

The cover member 22 is a cover portion that can take, upon opening and closing movements, a closed position (FIG. 2) for covering the sheet discharge port 16 and the sheet stacking tray 21 and serving as a wind shield (wind break), and an open position (FIG. 6) for allowing the taking out of the sheet(s) stacked in the sheet stacking tray 21. The cover member 22 is provided over the sheet stacking tray 21 and can pivot relative to the apparatus main unit 1 such that the cover member also covers side faces of the sheet stacking tray 21. A pivot shaft (pivot fulcrum) 22*a* of the cover member 22 engages with support portions 1*a* provided above the sheet discharge port 16 of the apparatus main unit 1 such that the cover member 22 is pivotably supported from the apparatus main unit 1. Projecting portions (engaging portions) 22*b* are provided on both inner side faces of the cover member 22 such that the projecting portions face each other and are able to engage with a sheet pressing member 23 (will be described).

The sheet pressing member 23 can move, upon opening and closing movements of the cover member 22, between an apart position (FIG. 2) which is apart from the stacked sheet(s) and a press-down position (FIGS. 5 and 6) for pressing the sheet(s) stacked on the sheet stacking tray 21. The sheet pressing member 23 is a bar or rod having an inverted U shape, and situated above the sheet stacking tray 21. The sheet pressing member 23 is provided such that the sheet pressing member 23 can pivot about support shafts 21*a* at both side faces of the sheet stacking tray 21. The sheet pressing member 23 includes a sheet press-down portion 23*a* for pressing the sheet(s), and arm portions 23*b* that are integral with the sheet press-down portion and can engage with the projecting portions 22*b* of the cover member 22. As shown in FIG. 2, the sheet pressing member 23 is pushed by the projecting portions 22*b* of the cover member 22 so that the sheet pressing member 23 is brought into an apart state, i.e., the sheet pressing member 23 is sufficiently distant from the sheet stack surface of the sheet stacking tray 21, when the cover member 22 is at the closed position. When the cover member 22 is at the open position, as shown in FIG. 6, the projecting portions 22*b* of the cover member 22 leave the arm portions 23*b* of the sheet pressing member 23. In this state, the sheet pressing member 23 is biased toward the sheet stacking tray 21 by its own weight, and takes a press-down position, i.e., the sheet press-down portion 23*a* of the sheet pressing member presses the sheet(s) S on the sheet stacking tray 21. The arm portions 23*b* of the sheet pressing member 23 and the projecting portions 22*b* of the cover member 22 constitute in combination a movement-linking portion that causes the sheet pressing member 23 to take the apart position when the cover member 22 is at the closed position and causes the sheet pressing member 23 to move to the press-down position from the apart position upon the opening movement of the cover member 22.

The movements of the sheet stacking portion 17 will be described in detail.

As the apparatus main unit 1 starts the printing operation, the toner image (developer image) formed on the photosensitive drum 2 of the image forming portion is transferred onto the sheet, and thermally fixed by the fixing device 10. The sheet on which the image is fixed is discharged toward the sheet stacking tray 21 from the sheet discharge port 16 by the discharge rollers 15. The sheet stacking tray 21 is covered with the cover member 22 that is at the closed position shown in FIG. 2. More specifically, the entire sheet stacking portion 17, including the discharge rollers 15 and the sheet discharge port 16, is covered with the cover member 22 located at the closed position. Therefore, the cover member 22 located at the closed position serves as the wind shield, and the sheet(s) being discharged or already stacked on the sheet stacking tray do not fall from the sheet stacking tray or scatter even if the wind blows outside the sheet stacking portion. Because the cover member 22 is at the closed position, the projecting portions 22*b* of the cover member 22 engage with the arm portions 23*b* of the sheet pressing member 23 and press the arm portions 23*b* so that the sheet pressing member 23 are sufficiently apart from the upper surface of the sheet stacking tray 21 (sheet pressing member is at the apart position). As such, the sheet pressing member 23 does not hinder the discharging of the sheet onto the sheet stacking tray 21.

When the apparatus main unit 1 finishes the printing operation, a user moves the cover member 22 to the open position in order to take (pick up) the sheet S (or a sheet bundle) from the sheet stacking tray 21. As the cover member 22 is opened, the projecting portions 22*b* of the cover member 22 that press the arm portions 23*b* of the sheet pressing member 23 (FIG. 5) leave the arm portions 23*b* of the sheet pressing member 23 prior to reaching the open position shown in FIG. 6. Thus, the sheet pressing member 23 descends due to its own weight and presses the sheet (or a sheet bundle) S stacked on the sheet stacking tray 21 before the cover member 22 arrives at the open position shown in FIG. 6. In this situation, the cover member 22 still covers the sheet stacking tray 21 and serves as the wind shield. In this manner, the sheet pressing member 23 presses the sheet (or a sheet bundle) S on the sheet stacking tray 21 before the cover member 22 takes the open position. Accordingly, even if the wind blows against the sheet (or a sheet bundle) S stacked on the sheet stacking tray, the sheet or sheets do not fall from the sheet stacking tray 21 or scatter around.

By further continuing the opening movement of the cover member 22, the sheet stacking tray 21 is brought to the open position. Then, the sheet pressing member 23 is lifted up, and the sheet (or a sheet bundle) S on the sheet stacking tray 21 are taken out (FIG. 6).

Because of the above-described structure, the following advantages are obtained.

During the discharging operation, the sheet (or a sheet bundle) S on the sheet stacking tray 21 is covered with the cover member 22 and the wind is blocked off. Therefore, the sheet (or a sheet bundle) S on the sheet stacking tray 21 does not fall off or scatter around.

When the cover member 22 is opened for taking the sheet S out, the sheet pressing member 23 presses the sheet S and then the cover member 22 leaves the upper surface of the sheet stacking tray 21. Accordingly, the sheet does not blow away or scatter in the wind.

The movement-linking portion of this embodiment has the arm portions 23*b* on the sheet pressing member 23, and the projecting portions 22*b* provided on the inner faces of the cover member press the arm portions 23*b* such that the sheet pressing member 23 presses the sheet S on the sheet stacking tray 21 in conjunction with the opening movement of the cover member 22. It should be noted, however, that the structure of the movement-linking portion for associating the opening movement of the cover with the movement of the sheet pressing member is not limited to the above-described structure. Any suitable structure may be employed as long as the sheet pressing member may press the sheet on the sheet stacking tray before the cover reaches the open position.

Although in this embodiment the sheet pressing member 23 is biased toward the sheet stacking tray 21 by its own weight to press the sheet S on the sheet stacking tray 21, the structure for the sheet pressing member to press the sheet bundle on the sheet stacking tray is not limited to the structure described in the embodiment. For example, the sheet pressing member may be biased toward the sheet stacking tray by a biasing member, such as a spring, to press the sheet (or a sheet bundle) on the sheet stacking tray.

Figure 7:
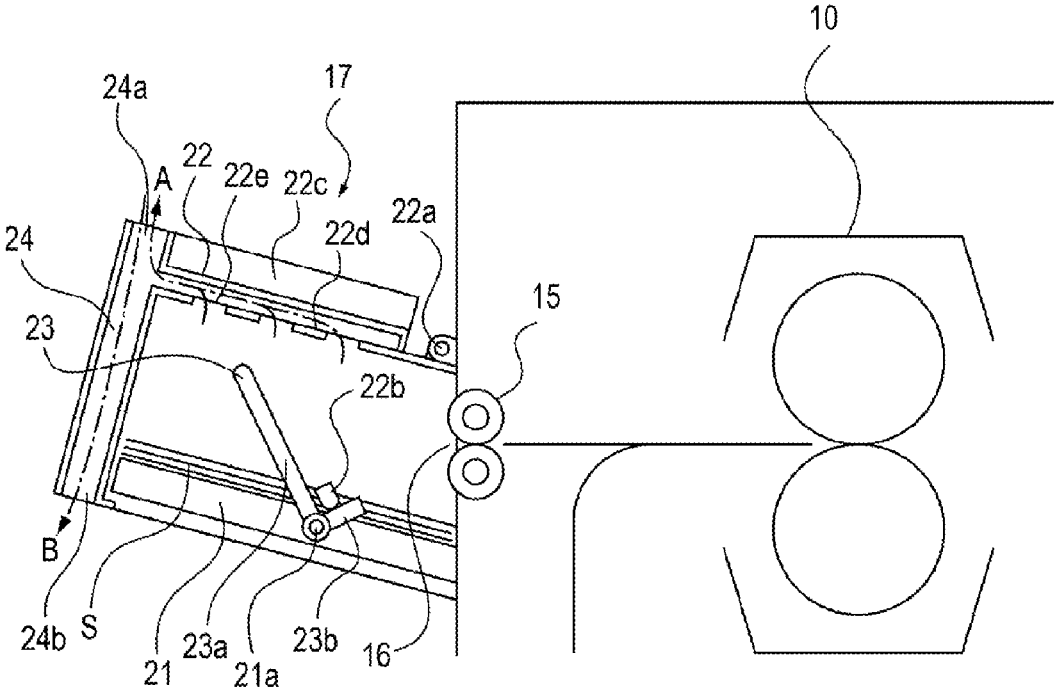
FIG. 7 illustrates a cross-sectional view of major components of the sheet stacking portion according to Embodiment 2.

<Embodiment 2>The structure of the apparatus according to Embodiment 2 will be described with reference to FIG. 7. FIG. 7 illustrates a cross-sectional view of major components of the sheet stacking portion according to Embodiment 2.

In the following description, the same reference numerals and symbols as those used in Embodiment 1 are assigned to those members and components of Embodiment 2 which have the same functions as the apparatus of Embodiment 1, and the description of such members and components is omitted.

In the sheet stacking portion of this embodiment, the top panel of the cover member 22 has the double top panels 22*c* and 22*d*. Among the double top panels 22*c* and 22*d*, the lower top panel 22*d* has a plurality of holes 22*e*. A generally vertically extending duct 24 having an upper opening 24*a* and a lower opening 24*b* is provided at the peripheral edges of the double top panels 22*c* and 22*d*, and the space defined by the duct 24 and the double top panels 22*c* and 22*d* communicates with the atmosphere. Other structures are the same as or similar to the above-described Embodiment 1.

The above-described configuration of Embodiment 2 provides the following advantages.

Because the sheet is discharged from the sheet discharge port 16 after the thermal fixing on the sheet is finished in the apparatus main unit 1, the sheet is stacked at a high temperature on the sheet stacking tray 21. In particular, when the image forming apparatus performs high speed printing, the sheet is stacked at an even higher temperature, and therefore the sheet may adhere to another sheet if the toner on the sheet is not sufficiently fixed.

In the above-described configuration, the high temperature air is expelled from the openings 22*e* of the lower top panel 22*d* of the double top panels 22*c* and 22*d* as indicated by the arrow A. Thus, the sheet does not keep the high temperature, and the sheet does not adhere to another sheet.

Because the duct 24 provided at the peripheral edges of the double top panels 22*c* and 22*d* has the upper and lower openings 24*a* and 24*b*, the wind blows from, for example, the opening 24*a* to the opening 24*b* as indicated by the arrow B even if the wind blows against the sheet stacking tray 21. Thus, the wind does not reach the sheet (or a sheet bundle) S on the sheet stacking tray 21, and therefore the sheet (or the sheet bundle) is not scattered.

Although the image forming apparatus is the printer in the above-described embodiments, the present invention is not limited in this regard. For example, the image forming apparatus may be other types of image forming apparatus such as a copying machine and a facsimile machine, or yet other types of image forming apparatus such as a multi-function printer that has the combined functions of the copying machine and facsimile machine. By applying the present invention to a sheet stacking apparatus of such image forming apparatus, the same advantages as those described in the foregoing are obtained.

Although the sheet stacking apparatus is integral with the image forming apparatus in the above-described embodiments, the present invention is not limited in this regard. For example, the sheet stacking apparatus may be removable from and attachable to the image forming apparatus. By applying the present invention to such sheet stacking apparatus, the same advantages as those described above are obtained.

Although the sheet stacking apparatus is used for the image forming apparatus in the above-described embodiments, the present invention is not limited in this regard. For example, the sheet stacking apparatus of the present invention may be used for a sheet processing apparatus that can selectively perform the aligning process to the sheets and the stapling (or binding, filing) process to the sheets. In this case, the same advantages as those described above are obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-090538, filed Apr. 23, 2013, which is hereby incorporated by reference herein in its entirety.

What is claimed is:

1. A sheet stacking apparatus comprising:

a sheet stacking portion on which a sheet discharged from a sheet discharge port is stacked;

a cover portion configured to move to a closed position for covering the sheet discharge port and the sheet stacking portion and an open position for allowing taking out of the sheet stacked on the sheet stacking portion;

a sheet pressing portion configured to move to a press-down position for pressing the sheet stacked on the sheet stacking portion and an apart position that is distant from the sheet stacked on the sheet stacking portion; and a movement-linking portion configured to cause the sheet pressing portion to move from the apart position to the press-down position upon an opening movement of the cover portion.

2. The sheet stacking apparatus according to claim 1, wherein the movement-linking portion has an arm portion provided on the sheet pressing portion, and an engaging portion provided on the cover portion for engaging with the arm portion, and wherein the engaging portion engages with the arm portion to bring the sheet pressing portion to the apart position when the cover portion is at the closed position, and the engaging portion disengages from the arm portion to cause the sheet pressing portion to move to the press-down position when the cover portion is at the open position.

3. The sheet stacking apparatus according to claim 2, wherein the engaging portion is disengaged from the arm portion as the engaging portion moves upon the opening movement of the cover portion.

4. The sheet stacking apparatus according to claim 1, wherein the cover portion has a box shape, and is opened and closed about a pivot-movement fulcrum provided above the sheet discharge port.

5. The sheet stacking apparatus according to claim 1, wherein the cover portion has double top panels, an inner top panel of the double top panels has a plurality of holes, and space formed between the double top panels communicates with an atmosphere.

6. An image forming apparatus comprising:

an image forming portion for forming an image on a sheet; and a sheet stacking apparatus defined by claim 1 for stacking the sheet on which the image is formed by the image forming portion.

7. A sheet stacking apparatus comprising:

a sheet stacking tray on which a sheet discharged from a sheet discharge port is stacked;

an openable cover member configured to move to a closed position for covering the sheet discharge port and the sheet stacking tray and an open position for allowing taking out of the sheet stacked on the sheet stacking tray;

a sheet pressing member pivotably supported and configured to move to a first position where the sheet pressing member is apart from the sheet stacking tray and to a second position closer to a stacking surface of the sheet stacking tray;

an arm portion integral with the sheet pressing member; and an engaging portion provided on the cover member for engaging with the arm portion to bring the sheet pressing member to the first position when the cover member is at the closed position, and for disengaging from the arm portion to cause the sheet pressing member to press a sheet on the stacking surface of the sheet stacking tray when the cover member is at the open position.

8. The sheet stacking apparatus according to claim 7, wherein the sheet pressing member has a rod-shaped sheet press-down portion for pressing an upper face of the sheet stacked on the sheet stacking tray, and a support shaft for pivotably supporting the sheet press-down portion, the arm portion extending from the support shaft in a direction opposite an extending direction of the sheet press-down portion.

9. The sheet stacking apparatus according to claim 7, wherein the cover portion has a box shape, and is opened and closed about a pivot-movement fulcrum provided above the sheet discharge port.

10. The sheet stacking apparatus according to claim 7, wherein the cover member has double top panels, an inner top panel of the double top panels has a plurality of holes, and space formed between the double top panels communicates with an atmosphere.

11. An image forming apparatus comprising:

an image forming portion for forming an image on a sheet; and a sheet stacking apparatus defined by claim 7 for stacking the sheet on which the image is formed by the image forming portion.

12. An image forming apparatus according to claim 7, wherein the sheet pressing member presses the sheet on the stacking surface of the sheet stacking tray by its own weight.

13. An image forming apparatus according to claim 7, wherein the sheet pressing member presses the sheet on the stacking surface of the sheet stacking tray by a biasing member.

* * * * *